US006666363B2

(12) United States Patent
Godshaw et al.

(10) Patent No.: US 6,666,363 B2
(45) Date of Patent: Dec. 23, 2003

(54) SHOULDER AND LUGGAGE STRAP

(75) Inventors: Donald E. Godshaw, Evanston, IL (US); Michael Sanders, Montreal (CA)

(73) Assignee: Travel Caddy, Inc., Des Plaines, IL (US)

( * ) Notice: Subject to any disclaimer, the term of this patent is extended or adjusted under 35 U.S.C. 154(b) by 119 days.

(21) Appl. No.: 10/085,835

(22) Filed: Feb. 28, 2002

(65) Prior Publication Data

US 2003/0160078 A1 Aug. 28, 2003

(51) Int. Cl.[7] ..... A45C 13/00

(52) U.S. Cl. ..... 224/578; 224/607; 224/250; 190/115; 190/109

(58) Field of Search ..... 224/153, 575, 224/250, 647, 150, 257, 258, 576, 578–580, 600, 607; 150/108, 109; 190/115, 109; D3/327, 279

(56) References Cited

U.S. PATENT DOCUMENTS 4,613,068 A * 9/1986 Bianchi ..... 224/602
5,354,131 A * 10/1994 Mogil ..... 150/109
5,431,317 A * 7/1995 Kliot ..... 224/153
5,664,713 A * 9/1997 Burgstahler ..... 224/250
5,713,439 A * 2/1998 Zionts et al. ..... 190/108
6,109,403 A * 8/2000 Godshaw ..... 190/115
6,138,882 A * 10/2000 Buettner ..... 224/250
6,318,552 B1 * 11/2001 Godshaw ..... 190/109
6,375,053 B1 * 4/2002 Cecchinel ..... 224/267
6,375,056 B1 * 4/2002 Henri ..... 224/250
6,550,592 B1 * 4/2003 Godshaw et al. ..... 190/107

* cited by examiner

*Primary Examiner*—Nathan J. Newhouse
(74) *Attorney, Agent, or Firm*—Banner & Witcoff, Ltd.

(57) ABSTRACT

Luggage comprising a luggage case with wheels mounted on the case and a telescoping handle further includes an adjustable length shoulder strap which includes an auxiliary loop attachment for attaching the strap to the telescoping handle when the strap is not being used to avoid dragging of the strap or catching of the strap on the case wheels.

6 Claims, 10 Drawing Sheets

FIG.3
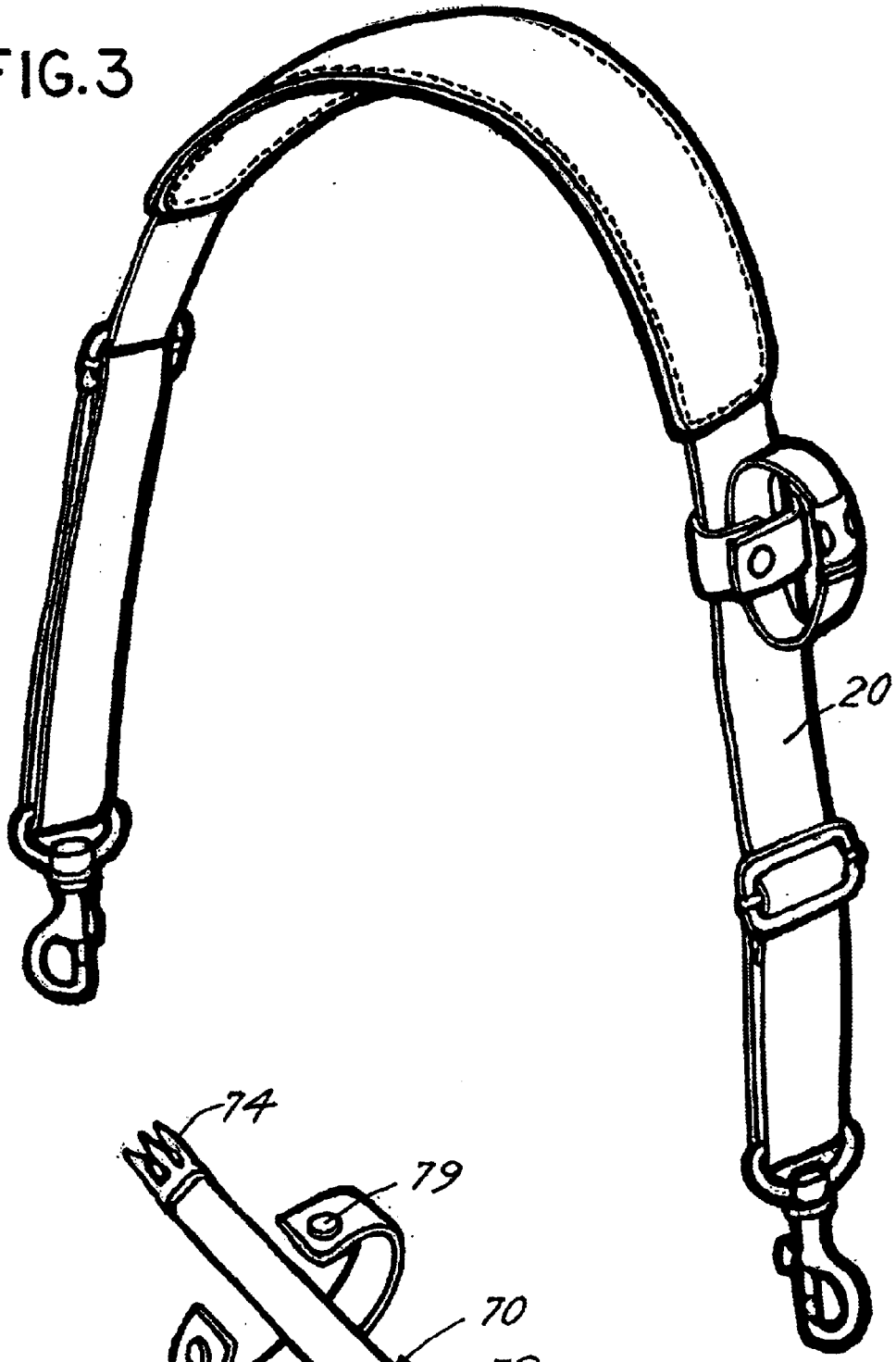
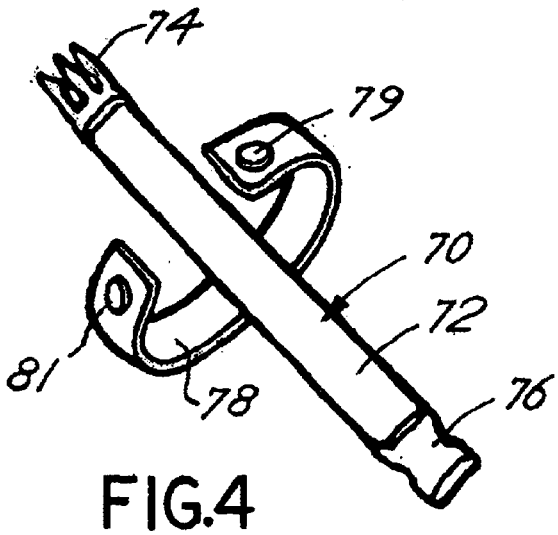
FIG.4

SHOULDER AND LUGGAGE STRAP

BACKGROUND OF THE INVENTION

In a principal aspect, the present invention relates to a shoulder strap for luggage which typically is used in combination and incorporated with luggage of the type, including a luggage case with wheels mounted on the case and a telescoping handle integrated into the case.

Travelers employ luggage which, nowadays, typically includes wheels and a telescoping handle to facilitate movement of the luggage. Airline carryon luggage often includes such a luggage construction to facilitate ease of movement and storage of the luggage. Such luggage may further include a shoulder strap attached to the sides of the luggage to facilitate carrying of the luggage, particularly up and down stairs or steps or in other circumstances where use of the luggage handle and the wheels is inconvenient. Changing from use of a shoulder strap to use of a telescoping handle often involves, however, necessary removal or detachment of the shoulder strap since it may otherwise drag on the ground or interfere with the ease of movement of the wheeled luggage. Removing the shoulder strap and then replacing it when needed may cause undue delay and interruption in the movement of the individual using the luggage. Therefore, there has developed a need to provide a shoulder strap construction which may be easily converted between use of the shoulder strap to support or carry luggage and storage of the strap in order to accommodate the mode of use of luggage utilizing wheels and a telescoping handle.

SUMMARY OF THE INVENTION

Briefly, the present invention comprises luggage of the type including a luggage case having wheels mounted on the case and a telescoping handle projecting from the case wherein the luggage further includes a shoulder strap which is adjustable in length and which includes a mechanism for temporarily connecting the strap to or disconnecting the strap from the telescoping handle. More specifically, the luggage shoulder strap may be temporarily attached or detached from the telescoping luggage handle by means of an auxiliary loop attachment member or mechanism which is preferably positioned on the outside surface or face of the belt comprising the luggage shoulder strap and which includes buckles for effectively connecting and disconnecting the auxiliary loop about the telescoping handle.

Various embodiments of the invention are disclosed, including an embodiment which incorporates buckle members for attaching and detaching the auxiliary loop, an embodiment which utilizes hook and loop fasteners for attaching and detaching the auxiliary loop attachment device, an embodiment having a separate attachable auxiliary loop attachment device which may be incorporated with a preexisting shoulder strap construction, and an embodiment with an elastic or loop member which will slip over the entire luggage handle and thus does not require attachment buckle mechanisms or other mechanisms such as a hook and loop mechanism for attaching and detaching the luggage shoulder strap to the telescoping handle.

Thus, it is an object of the invention to provide an improved shoulder strap for use in combination with luggage of the type including a telescoping handle.

It is a further object of the invention to provide an improved luggage strap which may be easily attached and detached to a telescoping luggage handle as needed.

Another object of the invention is to provide a shoulder strap for luggage of the type including a telescoping handle wherein the shoulder strap includes an economical, inexpensive, rugged and adjustable mechanism for attaching and detaching the shoulder strap from a telescoping handle.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is an isometric view of a first alternative embodiment of the shoulder strap;

FIG. 4 is an enlarged isometric view of the auxiliary loop attachment member associated with the embodiment of FIG. 3;

DESCRIPTION OF THE PREFERRED EMBODIMENT

Figure 1:
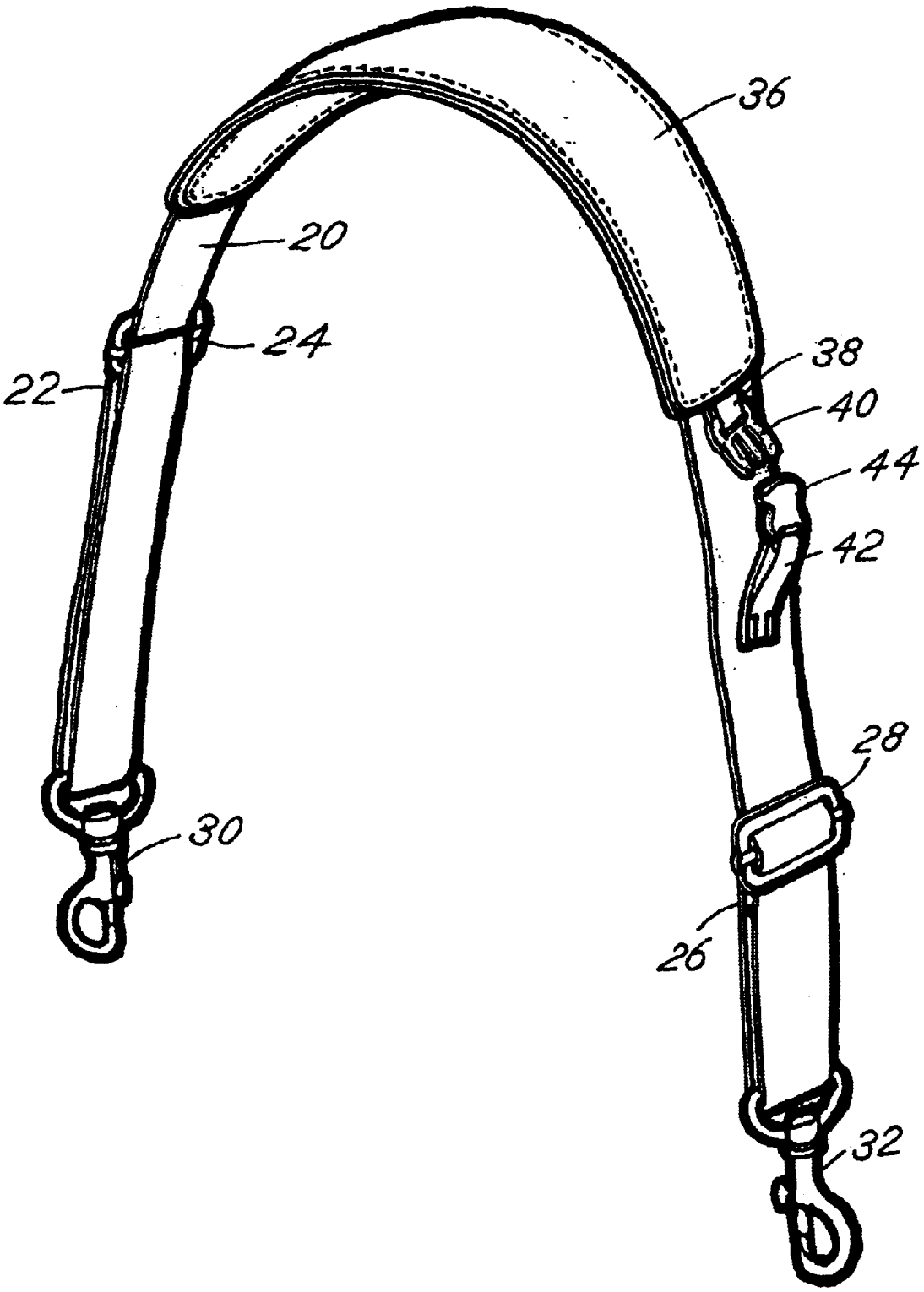
FIG. 1 is an isometric view of a first embodiment of the shoulder strap used in combination with luggage of the type including a telescoping handle.
Figure 2:
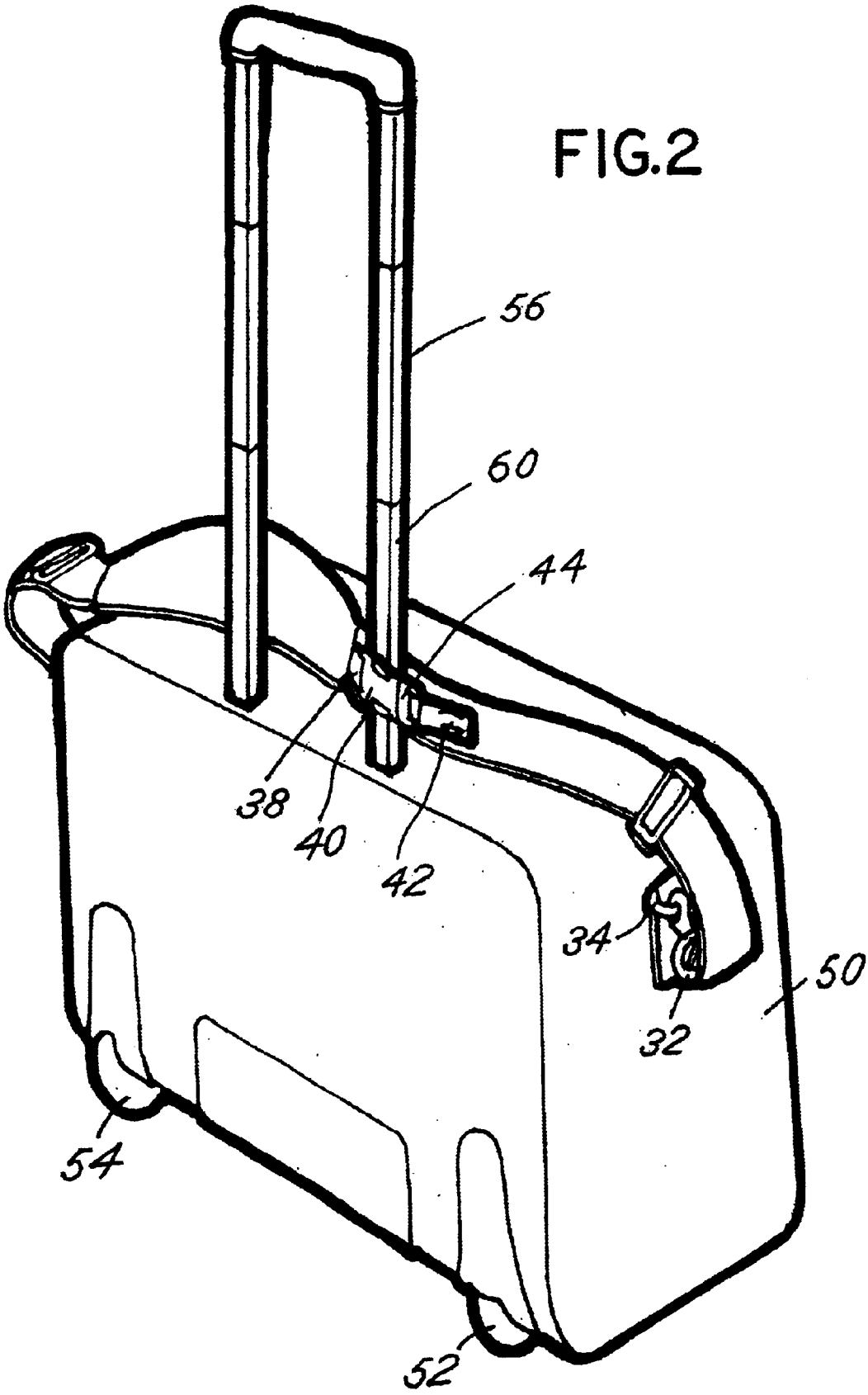
FIG. 2 is an isometric view of the shoulder strap of FIG. 1 in combination with a luggage case.

Referring to the figures, like numbers refer to like component parts with respect to each of the embodiments. FIGS. 1 and 2 illustrate a first embodiment of the invention. Referring to FIGS. 1 and 2, the embodiment comprises an elongate belt 20 having a first distal end 22 which is attached by means of an adjustable buckle 24 to the belt 20 so that the end of the belt 22 overlaps a portion of the belt 20 to permit adjustment of the length of the belt 20 and accommodate various length requirements of the person using the shoulder strap. Similarly, the belt 20 includes a second end 26 which is attached to a buckle 28 whereby the second end 26 overlaps the belt 20 to provide for length adjustment. The loops formed by the first end 22 and the second end 26 have associated therewith respectively a first attachment buckle 30 and a second attachment buckle 32. The attachment buckles 30, 32, as depicted in FIG. 2, attach to an attachment loop, such as attachment loop 34, for attachment buckle 32.

The belt 20 further includes a middle or intermediate shoulder pad section 36. The shoulder pad section may include a cushion pad which is sewn onto the belt 20.

An auxiliary loop attachment member is comprised of a short strap 38 with a connection buckle 40 attached thereto. The strap 38 is sewn to the belt 20 at one edge of the shoulder pad 36. A second strap 42 is provided with a connector 44. The connectors 40 and 44 may be attached one to the other to form a closed auxiliary attachment loop.

As shown in FIG. 2, a luggage case 50, includes wheels 52 and 54, further includes a telescoping handle 56. The auxiliary loop attachment member, and more particularly, the straps 38 and 42, may be connected by the connectors 40 and 44 about the telescoping bar 60. In this manner, the shoulder strap may be retained at its adjusted length, but will be guided and positioned and maintained on handle 56 so that it will not drag on the ground by means of the telescoping handle 56.

Figure 5:
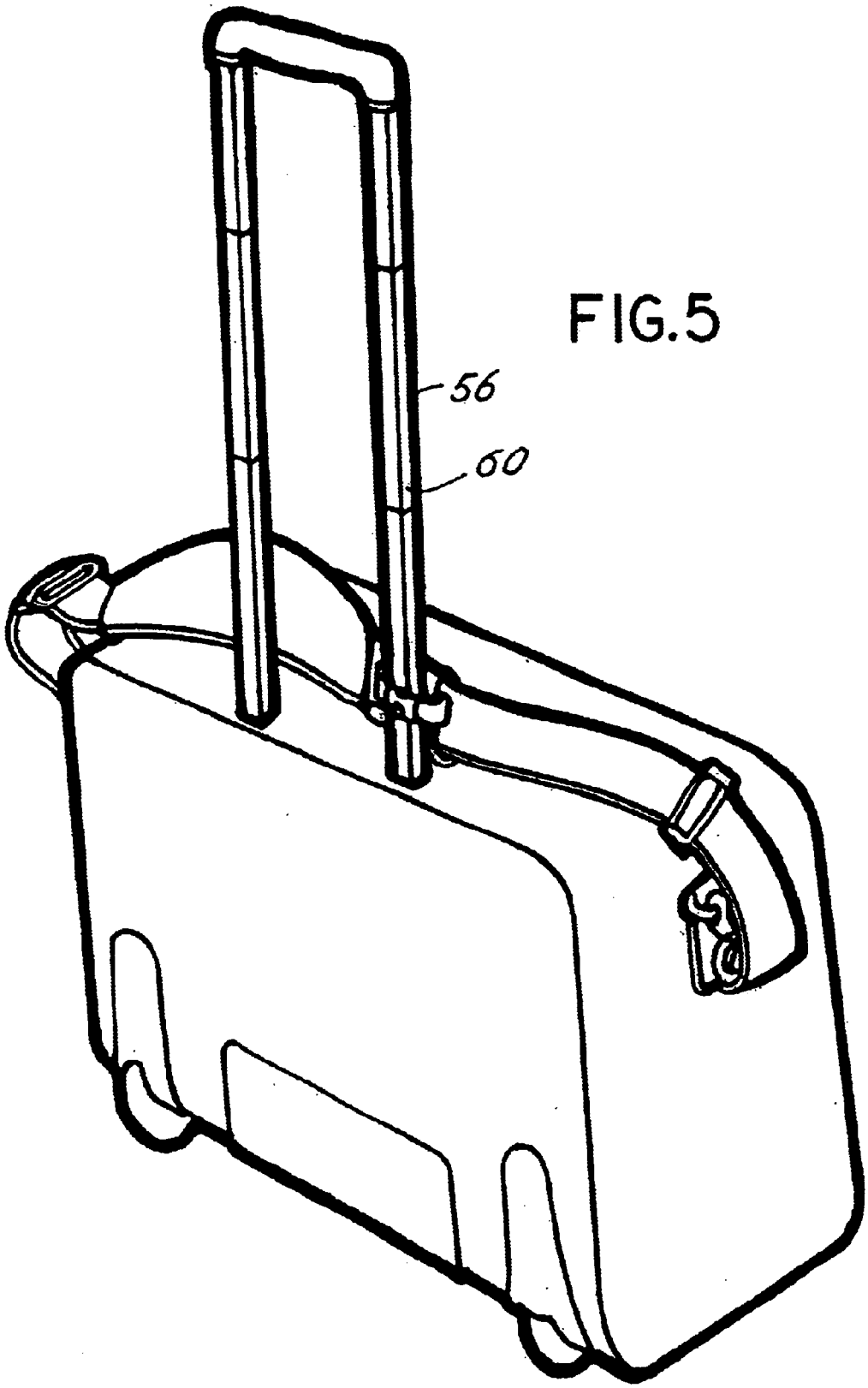
FIG. 5 is an isometric view of the embodiment of FIG. 3 as incorporated with a luggage item.

The remaining figures depict various alternative embodiments. In FIG. 3, there is depicted a removable auxiliary loop attachment 70 which includes an elongate strap 72 with a male connector 74 at one end and a companion female connector 76 at the opposite end. An attachment band 78 with fasteners 79, 81 at its opposite ends, is provided for attaching the auxiliary loop attachment 70 to belt 20 as depicted in FIG. 3. FIG. 5 depicts the manner by which the strap depicted in FIG. 4 may be attached to the telescoping handle 56 and more particularly to one bar 60 thereof.

Figure 6:
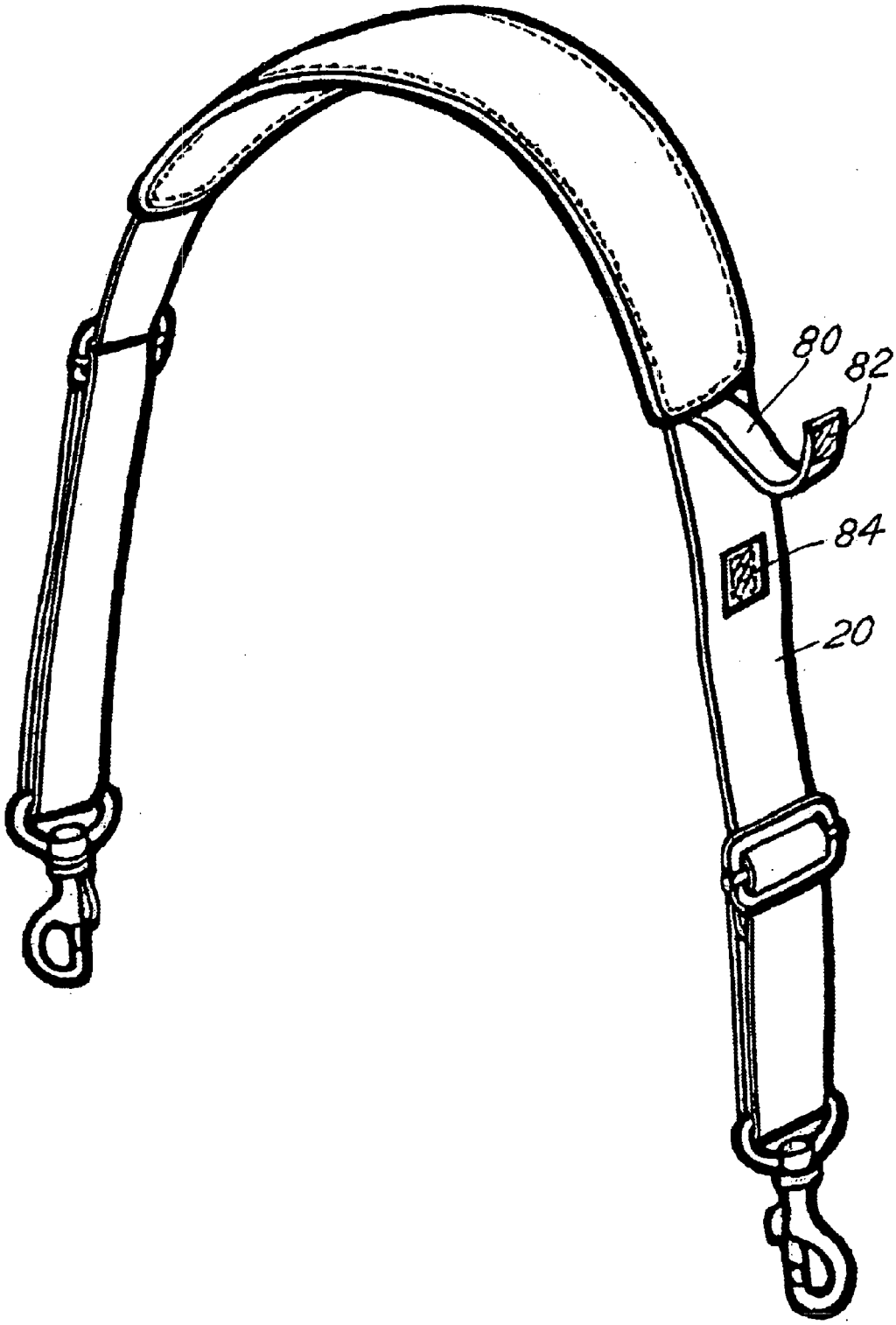
FIG. 6 is a second alternative embodiment of the invention in an isometric view.
Figure 7:
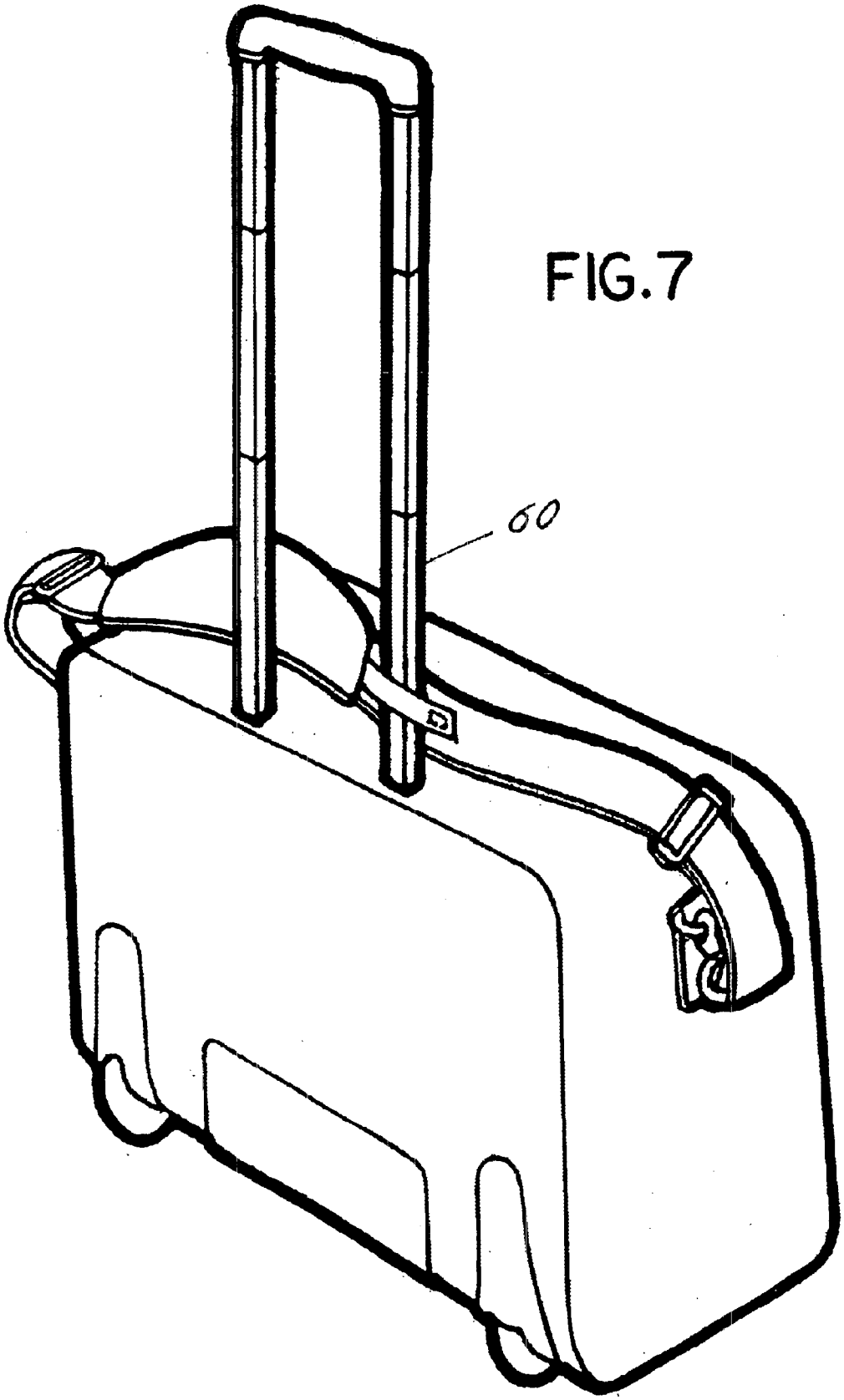
FIG. 7 is an isometric view of the embodiment of FIG. 6 incorporated in a luggage item.

FIG. 6 illustrates yet a further embodiment wherein a loop and hook mechanism (Velcro) may be used for attachment of an auxiliary strap or band 80. The band 80 thus includes a hook pad 82 which engages with a loop pad 84 attached to the belt 20. FIG. 7 illustrates the manner in which this arrangement may be used to attach the shoulder strap to a bar 60. Note that the auxiliary attachment band 80 is on the outside face of the belt 20 and does not interfere with the comfort of the shoulder strap. That is, it is positioned at one edge of the shoulder pad 36 of strap to avoid interference with the comfort or use of the shoulder strap. This arrangement of positioning of band 80 and its counterparts is preferred with respect to the first three embodiments described in FIGS. 1–7. FIG. 7, of course, shows the manner of use of the embodiment of FIG. 6.

Figure 8:
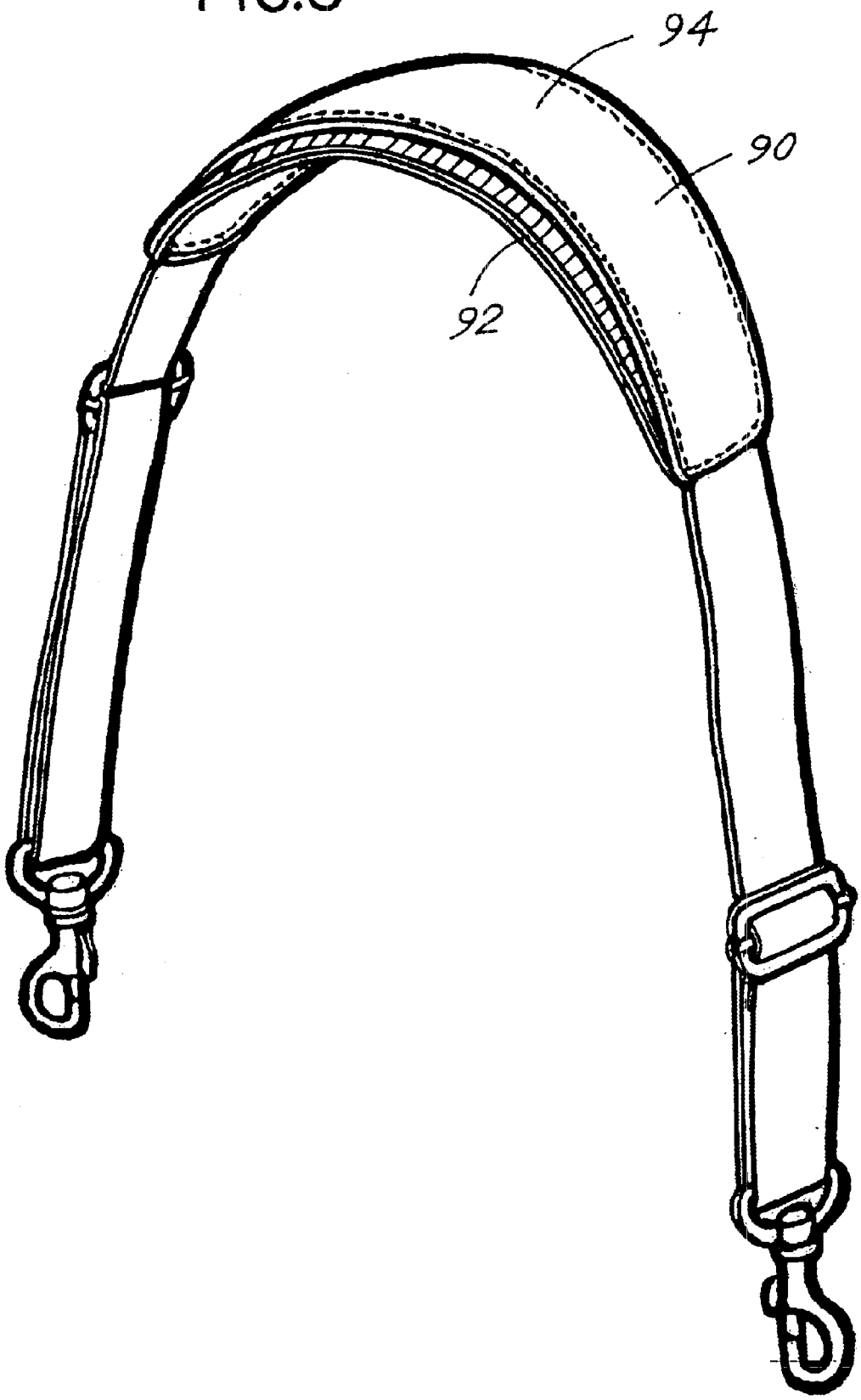
FIG. 8 is a third alternative embodiment of the invention in an isometric view.
Figure 9:
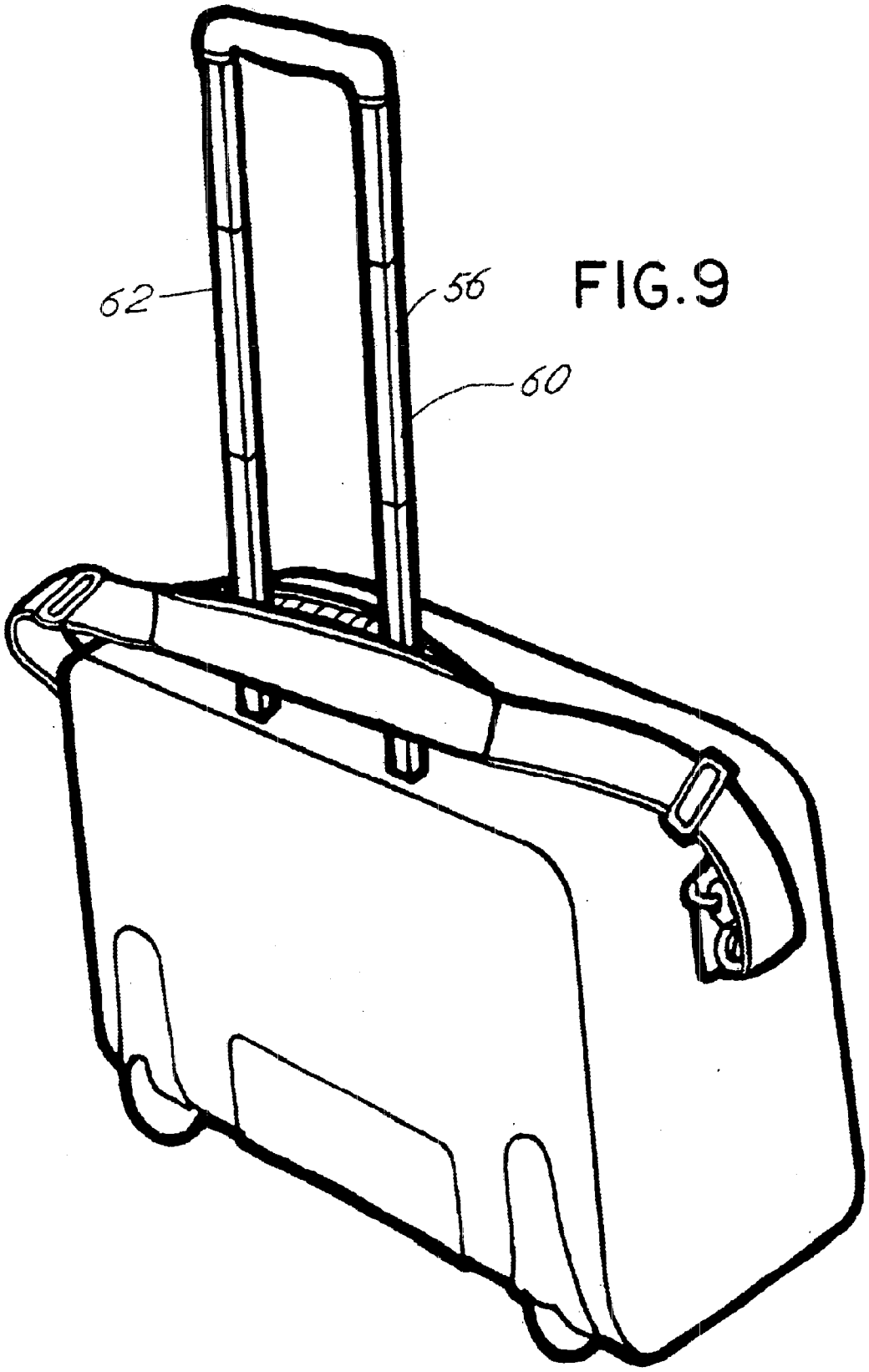
FIG. 9 is an isometric view of the embodiment of FIG. 8 incorporated in a luggage item.

FIG. 8 illustrates another embodiment. In FIG. 8 the shoulder pad 90 is divided into two separable sections or pad sections 92 and 94. The pad sections 92 and 94 are congruent and overlie one with the other but are separable as depicted in FIG. 9 so that they will fit over a telescoping handle 56 wherein the handle 56 is comprised of a first bar 60 and a second separate bar 62. In this embodiment, of course, the pad 90 has a dimension so that it will accommodate fitting over the spaced bars 60 and 62 comprising the handle 56 rather than secure attachment to a single one of the bars 60 or 62 as in the prior embodiments.

Figure 10:
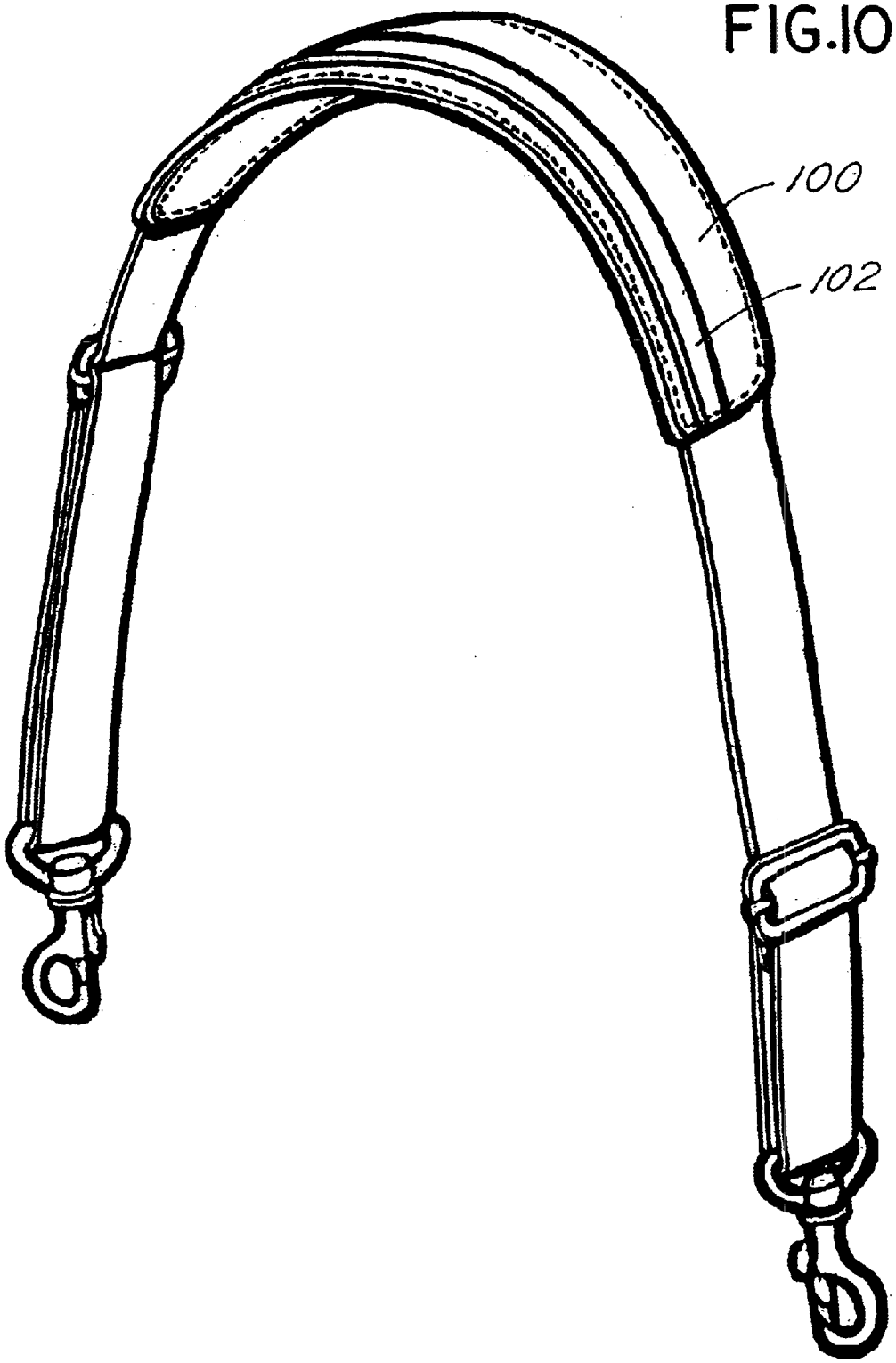
FIG. 10 is an isometric view of a shoulder strap incorporating the invention in a further embodiment.
Figure 11:
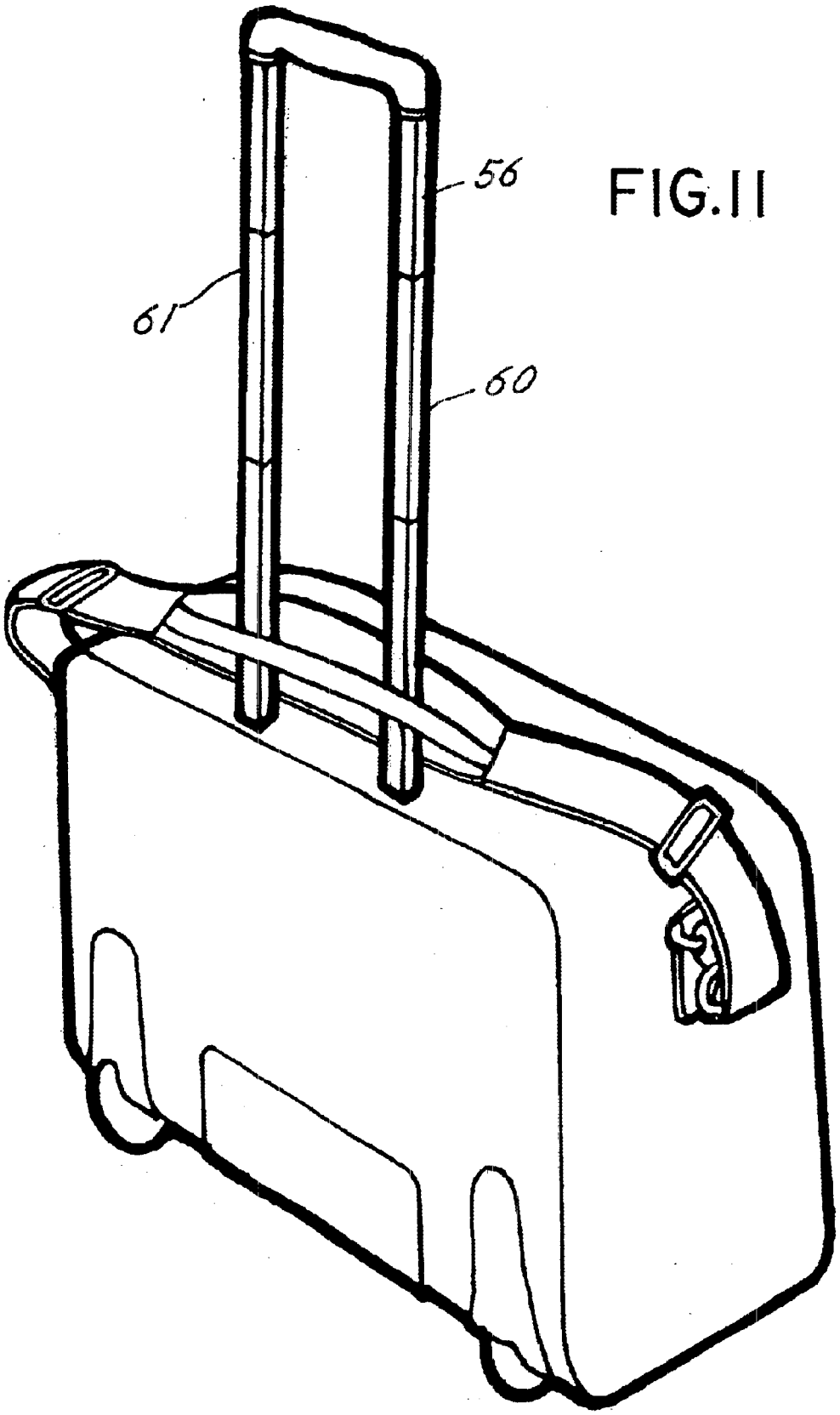
FIG. 11 is an isometric view of the embodiment of FIG. 10 incorporated in a luggage item.

FIGS. 10 and 11 illustrate a further embodiment employing the shoulder strap. In the embodiment of FIGS. 10 and 11, the shoulder pad 100 includes an elastic strap 102 which is congruent with the pad 100 and positioned on the outside face of the pad 100 to avoid interference with the cushioning feature of the pad 100. The elastic belt or member 102 thus fits over the spaced bars 60 and 61 of the telescoping handle 56 as illustrated in FIG. 11 and is not elastically distorted during use of the strap 20 over a shoulder.

Various other embodiments of the invention are considered to be within the scope of the disclosure. The position of the auxiliary attachments may be varied without departing from the spirit and scope of the invention. The means for attaching and fastening the elements comprising the auxiliary attachments may also be varied. The number of sub elements of the auxiliary attachments may also be varied. Thus, the invention is to be limited only by the following claims and their equivalents.

What is claimed is:

1. Luggage comprising, in combination, a luggage case, wheels mounted on the case, and a telescoping handle from the case, said luggage including a shoulder strap, and first and second connector members on the case for attachment of said shoulder strap to the case, said shoulder strap comprising a belt with first and second ends and an intermediate shoulder pad section, said belt including an adjustable length overlapping section at least at one of said ends with an adjustment buckle attaching said end to said belt, a first attachment buckle at the first end for attachment of the first end of the strap to said first connector member, a second attachment buckle at the second end for attachment of the strap to the second connector member, and said strap further including an auxiliary loop attachment member connected to the belt and separate from said intermediate shoulder pad section, said auxiliary loop attachment member including first and second separate, connectible ends and a connection mechanism for joining or releasing the ends whereby the ends are disconnected and then joined to fit around the handle thereby holding the shoulder strap on the handle.

2. The luggage of claim 1 wherein the connection mechanism comprises male and female connectors.

3. The luggage of claim 1 wherein the connector mechanism comprises a loop and hook connector.

4. The luggage of claim 1 wherein the auxiliary loop attachment member comprises a loop with separate ends and a separate attachment strap for attaching the loop to the belt.

5. The luggage of claim 1 wherein the shoulder pad section includes an inside face for fitting against the shoulder and an outside face, and the auxiliary loop attachment is attached to the outside face.

6. Luggage comprising, in combination, a luggage case, wheels mounted on the case, and a telescoping handle from the case, said luggage including a shoulder strap, and first and second connector members on the case for attachment of said shoulder strap to the case, said shoulder strap comprising a belt with first and second ends and an intermediate shoulder pad section, said belt including an adjustable length overlapping section at least at one of said ends with an adjustment buckle attaching said end to said belt, a first attachment buckle at the first end for attachment of the first end of the strap to said first connector member, a second attachment buckle at the second end for attachment of the strap to the second connector member, and said strap including an auxiliary loop attachment member connected to the belt and separate from intermediate shoulder pad section, said auxiliary loop attachment member including first and second ends, each end attached to the belt, and comprising an elastic strap which has a relaxed condition that overlies the belt without deformation of the belt, said auxiliary loop member extending generally along the length of the belt between the first and second ends of the shoulder strap whereby the auxiliary loop member is stretched to fit around the extended telescoping handle to thereby hold the shoulder strap on the telescoping handle.

* * * * *